US005941311A

United States Patent [19]

Newton

[11] Patent Number: 5,941,311

[45] **Date of Patent: *Aug. 24, 1999**

[54] DOWN-HOLE, PRODUCTION PUMP AND CIRCULATION SYSTEM

[75] Inventor: Carl Robert Newton, Marrero, La.

[73] Assignee: Newton Technologies, Inc., Marrero, La.

[ * ] Notice: This patent is subject to a terminal disclaimer.

[21] Appl. No.: 08/762,870

[22] Filed: Dec. 12, 1996

Related U.S. Application Data

[63] Continuation-in-part of application No. 08/237,662, May 4, 1994, Pat. No. 5,655,604.

[51] Int. Cl.[6] ..... E21B 43/12

[52] U.S. Cl. ..... 166/369; 166/105; 417/444

[58] Field of Search ..... 166/369, 105, 166/107, 108, 68; 417/443, 444, 554, 450, 448, 434

[56] References Cited

U.S. PATENT DOCUMENTS

| | | | |
|---|---|---|---|
| 2,131,299 | 9/1938 | Reagin | 417/444 |
| 2,764,940 | 10/1956 | Long | 166/105 |
| 3,414,057 | 12/1968 | Harbison | 417/434 X |
| 4,157,117 | 6/1979 | Huckaby | 166/369 X |
| 4,573,529 | 3/1986 | Reinhardt | 166/105 X |
| 4,867,242 | 9/1989 | Hart | 166/369 |
| 4,880,062 | 11/1989 | Bland et al. | 166/105 X |
| 5,062,480 | 11/1991 | Chacin U. et al. | 166/105 X |
| 5,382,142 | 1/1995 | Spears | 417/445 |

FOREIGN PATENT DOCUMENTS 186923 11/1996 Russian Federation ..... 166/105

OTHER PUBLICATIONS

Descriptive flyer of "Spears Backwash Valve".

*Primary Examiner*—Hoang C. Dang
*Attorney, Agent, or Firm*—C. Emmett Pugh; Pugh & Associates

[57] ABSTRACT

A production pump & circulation tool (1, FIG. 1) used down-hole on the end of a production string (FIG. 10) including: a combined traveling valve assembly bottom connector (10) and fishing tool section (20) which engages gripping pins (51) for twisting the tool and is associated with a traveling ball valve (11/12); a sleeve (30); peripherally spaced, "J" slots (43) in an outer member (40) in which guide pins (52) move changing the tool's state with rotation about a longitudinal axis; a biasing spring (81); a standing valve assembly (50) which carries at its top a projector for unseating the traveling ball valve and to which the pins are attached and which encloses a standing valve ball (50A) and carries its seat (50B); a combined bushing (60) and top spring seat (70); a spring housing (80); and a standing valve projector (90) which can unseat the standing ball from its valve seat when the assembly 50 is lowered against the force of the spring. A pumping "valve locked closed" disposition (FIGS. 10B–D) and an injection "valve locked open" disposition (FIG. 10E). An atomizer (270) is utilized and/or a standing valve injector (320) and/or a projector channel (93) in the lower standing valve projector (90) are utilized for injecting diluents. The tool barrel and plunger with a non-abrasive outer "lining" and a non-corrosive inner "lining".

14 Claims, 13 Drawing Sheets

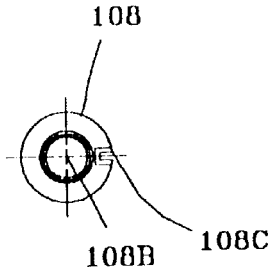
Fig.6D
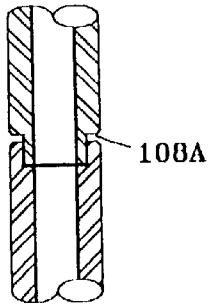
Fig.6C
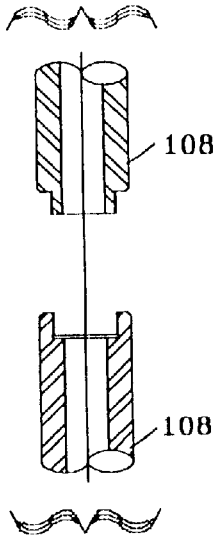
Fig.6B
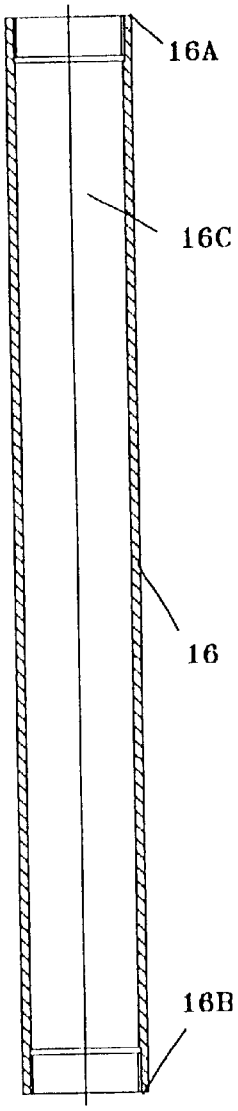
Fig.7
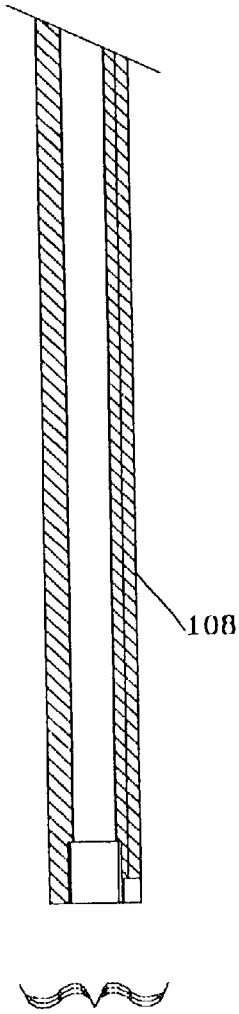
Fig.6A
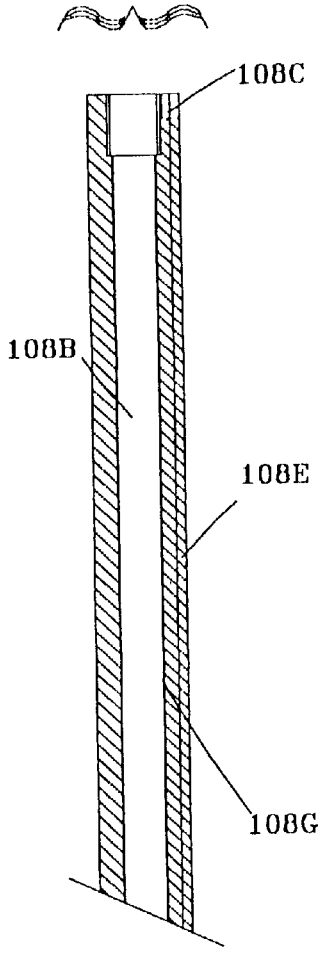

option 4

(optional)

DOWN-HOLE, PRODUCTION PUMP AND CIRCULATION SYSTEM

This is a continuation-in-part of U.S. patent application Ser. No. 08/237,662 filed on May 4, 1994 now U.S. Pat. No. 5,655,604 issued Aug. 12, 1997.

TECHNICAL FIELD

This invention relates to the production of oil and gas wells and the like, and more particularly to a system for down-hole fluid circulation in which the down-hole tool of the invention includes means for changing the state of the tool from a normal, pumping disposition, which allows the reciprocal, cyclical pumping of the production fluid to the surface, to a special circulation disposition, which allows fluids from the surface to be injected into the well, and back again, all without having to pull the tubing or sucker rod strings. The invention has significant energy savings and pollution prevention aspects.

BACKGROUND ART

It is common in the production field to use a reciprocating pumping system to pump the production fluid from the well up to the surface.

On occasion it is necessary or desirable to inject or circulate a fluid down into the hole and around the foundation of the production zone, such as various chemicals, steam, etc. In the prior art, for such to take place, the production operator had to pull the entire production string out of the hole and bring in a separate work-over rig at very great cost (e.g. $5,000 to $20,000/day) requiring relatively highly skilled engineers and causing a substantial amount of down time (e.g. two and a half days).

Furthermore, the injection of steam and other formation treating chemicals results in the corrosion and ultimate destruction of the string. The presence of silica sand and hydrogen sulfide ($H_2S$), common in formations, add further corrosion problems. Currently, a production string may last only fifteen (15) days when these problems are encountered. This significantly adds to the cost and efficiency of the oil production process.

Using the tool and methodology of the present invention, all of this is avoided, with substantial savings in energy production costs. With the invention's tool at the end of the production string, the operator using, for example, two rough-necks or roustabouts, basically merely changes the state of the tool from its production flow or pumping disposition to its fluid injection state by merely twisting the internal part of the tool down in the hole by, for example, about ninety (90°) degrees, and allowing or causing an internal part to longitudinally move with respect to the outer part(s), and injecting the fluid down through the production string. Once the fluid is injected, the rough-necks or roustabouts merely twist the tool back to its production state and re-initiate production, all with relatively little down time and relatively little expense.

Further, a production string is provided in which the plunger and barrel elements have an anti-corrosive inner "lining" and an anti-abrasive outer "lining". Thus the corrosion problems encountered in the presence of hydrogen sulfide and silica sand, or when steam and/or chemicals are injected, are obviated. The lifespan of the production string is greatly extended beyond the current fifteen days to at least two years.

For general informational purposes, it is noted that the inventor hereof became aware of a back-wash tool, designed by Spears Specialty Oil Tools, Inc. of Tomball, Tex., in which tool there were two, in-line ball valves, in which the bottom one was designed to be knocked off of its seat, when so desired, by the use of a downwardly and sidewardly moving, spoon-like structure, which didn't work reliably and only provided a relatively small opening rather than the full bottom opening of the present invention. A patent issued to Spears (U.S. Pat No. 5,382,142) on Jan. 17, 1995.

Thus, in contrast, the present invention overcomes the prior art problems by providing a down-hole circulation system which is safe, reliable, easy and inexpensive to use, saving many thousands of dollars on a regular basis over the prior art approaches, while also providing significant energy savings and enhanced pollution prevention.

GENERAL DISCUSSION OF INVENTION

The present invention is thus directed to a down-hole production tool which has at least two dispositions, a usual, production mode in which production flow pumping takes place using, for example, the standard, reciprocating "horse head" pumps now in extensive use in production fields, and an injection mode in which fluids from the surface are injected down the production tubing through the down-hole tool on an intermittent basis, preferably using two ball valves in line, one above the other. In changing from one mode to the other and back again, in the preferred, exemplary embodiment the upper, inner portion of the tool is twisted a relatively small initial amount (e.g. about 45°) with respect to the outer, lower portions or basic body of the tool about a longitudinal, center-line axis, which allows the respective portions to then move a small, limited amount in the longitudinal direction with respect to one another under the control of, for example, at least one, radially directed pin traveling in, for example, a "J" like slot with an upper tail. With another relatively small twist (e.g. about another 45°), the pin is then locked into a selected one of at least two peripherally and longitudinally spaced, locking locations along the length of the slot. The methodology is then reversed to return the tool back to its other disposition.

One disposition of the invention provides a "valve locked open" disposition, in which the upper and lower ball valves are open, which is used for shipping and activation or injecting of surface fluids, and a "valve locked closed" or pumping disposition for production pumping, in which the upper and lower ball valves can alternately be opened and closed under the reciprocating action of, for example, the horse head pump on the surface, in similar fashion to the traveling and standing valve systems used in the prior art.

Three options for injecting steam and/or chemicals into the barrel are provided; one utilizes an atomizer/injector, one utilizes a standing valve injector, and one utilizes a channel in the lower standing valve projector. The pump barrel is provided with a barrel channel for the transmission of the injection fluid from an injector pump. Also, a check valve and nipple may or may not be used to control the fluid flow through the barrel channel to any one or more of the three injection options.

Such a system, including a relatively simple, reliable, down-hole tool carried at the bottom of the tubing and production barrel, avoids the many thousands of dollars incurred in the use of the current, prior art methodology.

It is thus a basic object of the present invention to provide a down-hole circulation system and related tool which is safe, reliable, easy and inexpensive to use, capable of operation by a relatively small work crew of two people, and saving many thousands of dollars on a regular basis over the currently accepted prior art approaches.

It is another object to provide significant energy savings.

It is a further object to have such a system which can handle the retrieval of, for example, heavy crudes, for example, 7° API on up, and the secondary retrieval of production fluids.

It is a still further object to provide a thicker bodied, anti-corrosive, anti-abrasive pump barrel that will allow for the temperatures necessary for steam injection without losing its properties, avoids breathing of the barrel during the pumping cycle increasing production efficiency, and has a relatively long life span.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 3 is a side view of an exemplary "horse head", reciprocating pumping system of a production well located on the surface with its ancillary equipment and with the exemplary tool of FIG. 1 located at the bottom of the hole at the end of the well production barrel, with part of the sucker rod string cut away for convenience in illustrating the over-all system on a single page of drawings; while FIG. 3A is a close-up, detail view of the down-hole, tool portion of the production string of FIG. 3.

FIGS. 6A–6D are side, cross-sectional and end views of the pump barrel element (108) of FIG. 3, with FIG. 6A being cut into two sections, and FIGS. 6B & 6C showing the interfacing between two adjacent pipe barrel sections, with the former being exploded and the latter being joined.

FIG. 7 is a side view of the pump plunger (16) of FIGS. 10A–10D, described below.

FIGS. 10A–10E are side views showing in sequence the tool of FIG. 1 going through its various dispositions from its shipping disposition (FIG. 10A) ultimately to its activated, fluid injection disposition (FIG. 10E), with the relative position of the traveling plunger shown in its relative position alongside the tool and with the position of an exemplary one of the locking pins in its respective position in its concurrent travel through its respective "J" slot being illustrated along side of the tool in the production string for convenience, all as more fully outlined below, wherein in:

FIG. 10A the tool is in a shipping disposition with the pin valve locked open, the upper, inner part of the tool at the zero (0°) degree position and with the spring compressed and the standing ball un-seated by the lower projector;

FIG. 10B the tool is in a pumping disposition with the pin valve locked closed, and the plunger having been lowered & the upper tool rotated, the upper, inner part of the tool at the ninety (90°) degree position, the spring un-compressed, the travel ball seated by gravity, and the standing ball seated by gravity, with no fluid flow yet initiated;

FIG. 10C the tool is in a pumping disposition with the pin valve locked closed, with an up-stroke or the plunger being raised, the spring un-compressed, with production fluid flow being sucked up, the travel ball seated by gravity, the standing ball un-seated by fluid flow, and production fluid flowing up to the surface;

FIG. 10D the tool is in a pumping disposition with the pin valve locked closed, with a down-stroke or plunger being lowered, the travel ball un-seated by fluid pressure, the standing ball seated, fluid flow stopped, except for fluid trapped above the standing ball valve; and FIG. 10E the tool is in an activation disposition with the pin valve "locked" open, the plunger lowered & the upper tool rotated back, the upper, inner part of the tool back at the zero (0°) degree position, the spring compressed, the travel ball un-seated by the upper projector, the standing ball un-seated by the lower projector, and with pressurized, treatment fluid flowing down from the surface.

BEST, EXEMPLARY MODES OF THE INVENTION

Structural Details of Tool 1

The exemplary, currently preferred embodiment of the tool of the present invention is described below as adapted for a system having conventional ball valves and seats.

Figure 1:
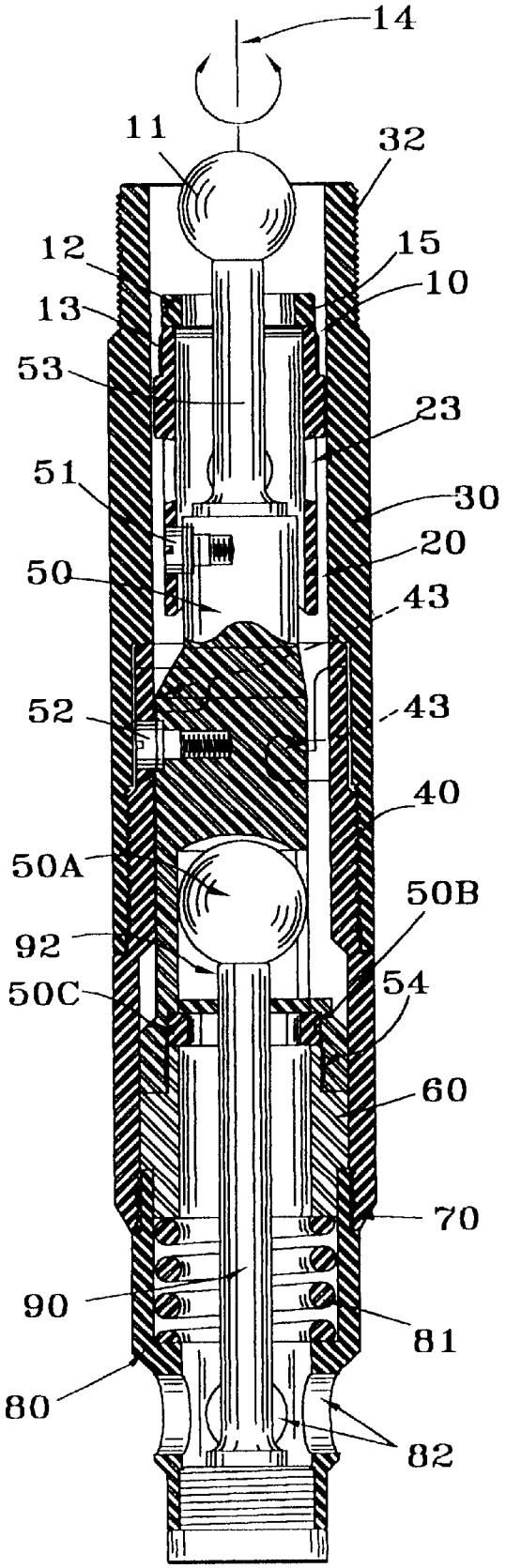
FIG. 1 is a side, cross-sectional view of an exemplary embodiment of the down-hole circulation tool used in the present invention, including its elemental parts, namely, an outer housing (formed by the exteriors of three, substantially cylindrical, separable segments), all of which in turn include an upper, a combined traveling valve assembly and fishing tool, a sleeve or coupling, a "J" slot member, a standing valve assembly, a combined bushing and top spring seat, a spring housing, and a standing valve projectile traveling ball valve, a lower, standing ball valve, an intermediate stem.
Figure 2:
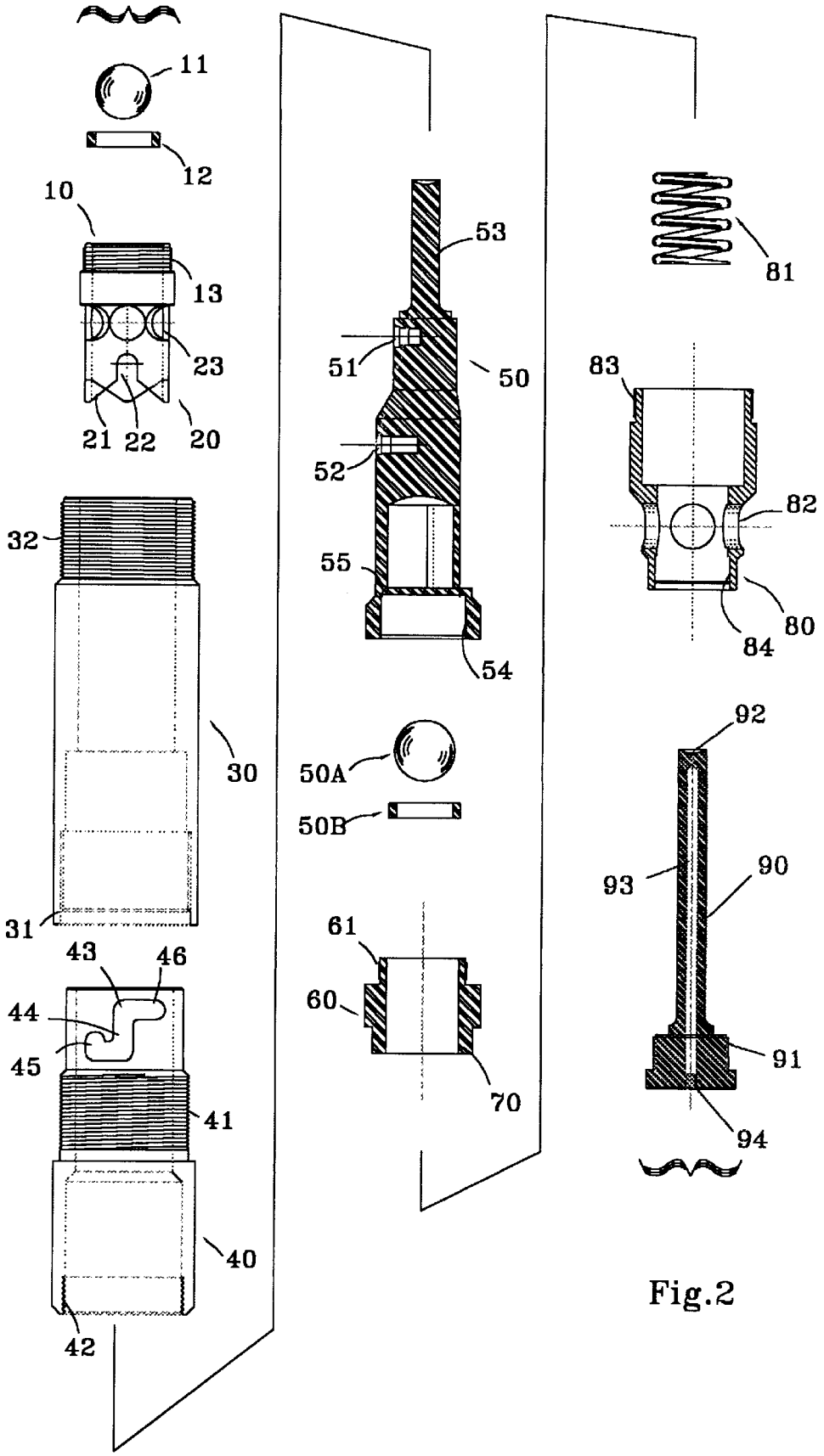
FIG. 2 is a side, exploded view of the embodiment of FIG. 1, illustrating the individual elements of the exploded embodiment.

As can be seen in assembled combination in FIG. 1 and in exploded array in FIG. 2, the exemplary embodiment of the tool 1 for the down-hole, production pump and circulation system of the present invention comprises the following basic parts:

- a hollow, combined traveling valve assembly bottom connector 10 and fishing tool section 20 (note FIG. 2) containing an upper, traveling valve ball 11 with an associated, lower valve seat 12 (also note FIG. 1);
- a hollow sleeve or coupling 30 (note FIGS. 1 & 2);
- a hollow, "J" slot member 40 (note FIGS. 1 & 2);
- a solid, longitudinally rotatable and longitudinally moveable, standing valve assembly 50 (note FIGS. 1 & 2) including within a bottom chamber a standing valve ball 50A and having at its top an upper, traveling valve ball projector 53;
- a hollow, combined bushing 60 and top spring seat 70 (note FIGS. 1 & 2) which can longitudinally move with the standing valve assembly 50;
- a hollow, spring housing 80 (note FIGS. 1 & 2); and
- a lower, standing valve projector 90 (note FIGS. 1 & 2).

The upper, traveling valve assembly bottom connector 10 places the ball valve element 11 and its associated seat 12 at the distal end of a plunger 16 (typically about two feet in length and described more fully below, also see FIGS. 10C & 8D) with its traveling cage and holds them in place, while the fishing tool section 20 (which can be provided as a separable screw-on section or integral with the valve assembly section as illustrated) projects down from the distal end of the plunger 16 and is used for fishing and engaging pins in connection with rotating the standing valve assembly 50 about a longitudinal, centerline axis 14 with respect to the main body of the tool formed by the combination of the sleeve 30, "J" slot member 40 & spring housing 80, all of which are screw-threadedly attached together and do not move longitudinally with respect to one another during down-hole use.

As can be seen in FIG. 2, the hollow fishing tool end 20 includes a "V" shaped, guide opening or entry 21, which in its converging sides leads into a longitudinally extended, straight, holding channel 22 for gripping a radially directed gripping pin 51 within it to thereby engage and rotate the standing valve assembly 50 to which the pin is attached, with the rotation being about the longitudinal, center-line axis 14. Three such "V" shaped entries 21, each of which abut the two others, each leading into centrally located, holding channels 22 (the center of each being separated by 120°), are included spaced about the circular periphery of the fishing tool section 20. Three circular openings 23 are also included spaced about the tool section's periphery to allow free and open fluid flow access to the hollow interior of the traveling assembly bottom connector 10.

Thus, the assembly bottom connector 10 is attached to the distal end of the traveling plunger 16 at 16B and its traveling assembly cage 17 by screw threads 13, which in turn is carried by a series of joined sucker rods 107 in the production well and can be longitudinally removed completely out of the main body of the tool 1 to reciprocatingly travel with the reciprocating and longitudinally moveable sucker rod string 107 (all as explained more fully below in connection with the operation of the tool 1).

The substantially cylindrical, hollow sleeve 30 surrounds and covers the main body of the longitudinally rotatable and longitudinally moveable standing valve assembly 50 and is screwed into the "J" slot member 40 at one end 31 and to the pump barrel 108 at the other end 32, these tool elements then being relatively unmovable with respect to one another during down-hole use.

The hollow "J" slot member 40 goes over and surrounds the standing valve assembly 50 and the lower, combined bushing 60 and top spring seat 70 and is screwed into the sleeve 30 at threads 41 (engaging sleeve threads 31), as noted above. Threads 42 at the other end are used to attach the spring housing 80 to the "J" slot member 40, which with the sleeve 30, form the main body of the tool 1.

Figures 10A, 10B, 10E:
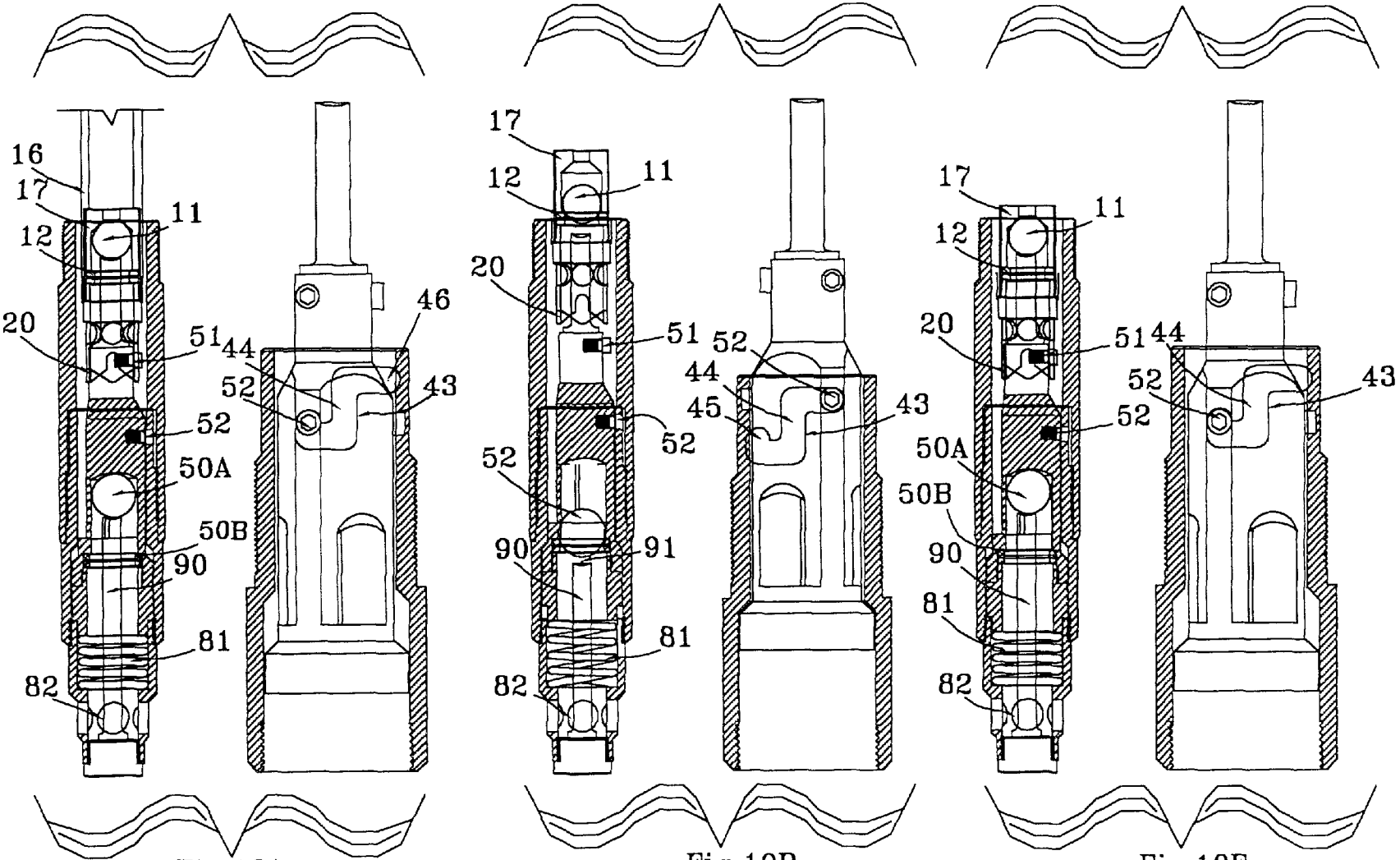

As can be best be seen in FIGS. 1, 2 & 10A+, the member 40 includes three peripherally spaced slots 43 somewhat in the form of "J"s extending primarily longitudinally (slot extensions 44 & 45) to form the "J"s with lateral tails 46 at their upper ends extending circumferentially. Radially directed guide pins 52 attached to the assembly 50 ride in the three slots 43 and guide and limit the amounts and directions of relative movement between the position of the standing valve assembly 50 (and its associated bushing 60) and the main body of the tool, including the fixed sleeve 30, the member 40 and the spring housing 80.

As described more fully below in connection with the operation of the tool 1, the radially directed pins 52 are moved about in the three "J" slots 43 of the "J" slot member 40, which position and intermittently lock together various parts of the tool 1 as parts thereof are relatively rotated and longitudinally moved with respect to one another, or more accurately the pins 52 restrict and guide the rotational and longitudinal movement of the assembly 50 with respect to the basic body members of the tool 1.

The standing valve assembly 50 extends down into the bottom of the "J" slot member 40 and the projector at its top 53 has the capability (depending on its longitudinal position) of moving the traveling ball 11 up off of its upper seat 12 (as shown in FIG. 1) for activation of the tool for, for example, injection of fluids from the surface or pulling a "dry" string up out of the hole. The valve assembly 50 defines a lower chamber in which the lower, standing valve ball 50A can move, as well as carries in its bottom area the seat 50B for the standing ball valve, and thus has the whole standing valve contained within it. The standing valve assembly is capable of both rotational movement and longitudinal movement with respect to the basic body of the tool 1, allowing the tool's disposition and basic nature to be changed from, for example, a "locked closed", pumping disposition to a "locked open", activation disposition.

The bushing 60, threadingly attached at threads 61 to the threaded, lower interior 54 of the assembly 50 and forced up with it by the spring 81, slides longitudinally up and down concurrently with the assembly 50 within the "J" slot member 40, while the underside of the top spring seat 70 provides a good bearing surface for the upper or top part of the spring 81. It is noted that there are tight tolerances between the exterior surfaces of the lower part of the assembly 50 and the bushing 60, on the one hand, and the interior surfaces of the "J" slot member 40, on the other, effectively providing a fluid tight seal between them, yet allowing the former elements to slide up and down over the opposing interior surfaces of the latter.

Supplemental seals could be provided between these relatively moveable surfaces, such as, for example, "O" rings or the like, if so desired. The bushing 60 and spring seat 70 can be integrated together, as illustrated, or, alternatively, could be provided, for further example, as separable parts screwed together.

The top, threaded part 83 of the spring housing 80 is screwed into the bottom of "J" slot member 40 at threads 42 and holds the biasing spring 81, which can be made, for example, of inconel. The housing 80 also has a bottom set of threads 84 for having the standing valve projector 90 screwed into its bottom. The spring housing 80 has a series of peripherally spaced, round holes 82, which allow for open fluid passage, as described more fully below in connection with the operation of the tool 1.

The standing valve projector 90, as noted above, is screwed into the bottom of the spring housing 80 using threads 91 and passes longitudinally through the open interior of the spring 81. The standing valve projector 90 forms the bottom-most part of the tool 1. The upper end 92 provides a projector surface that has the capability of raising the standing ball 50A off of its lower seat 50B (note FIGS. 10A & 10E).

The two ball valve seats 12 & 50B are sealed by "O" ring seals 15 & 50C, respectively, against their respective opposed surfaces, the former, opposed surface being the interior, cylindrical surface of the traveling valve cage 17, with the plunger 16 (both of which are not illustrated in FIG. 1 but see FIG. 10C) to which the traveling assembly bottom connector 10 will be attached, and the latter being the interior surface of the lower part 55 of the standing ball assembly 50.

Figure 4C:
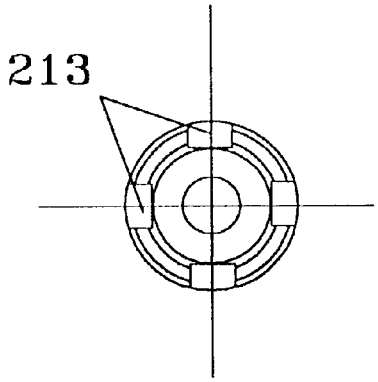
FIGS. 4A, 4B & 4C are side, cross-sectional and end views, respectively, of the plunger connector (210) of the plunger (16) of FIGS. 10A–10D and FIG. 7, all of which figures are described below, with FIGS. 4B & 4C rotated approximately forty-five (45°) degrees with respect to the disposition of FIG. 4A.
Figure 4A:
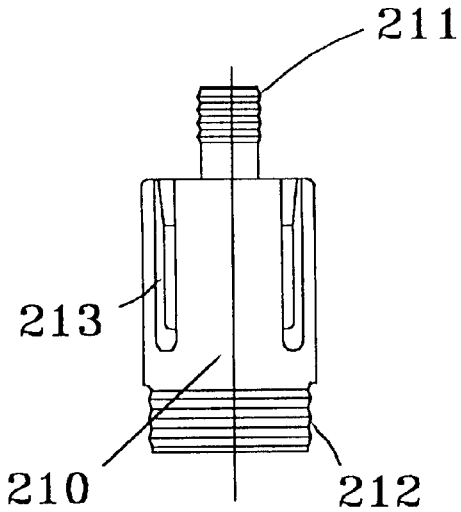
Figure 5B:
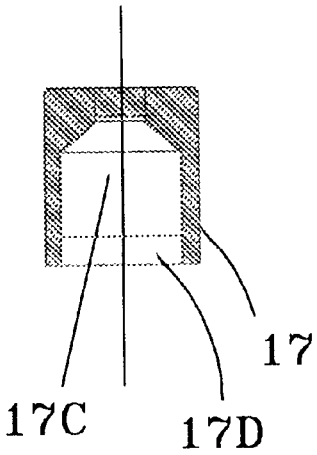
Figure 4B:
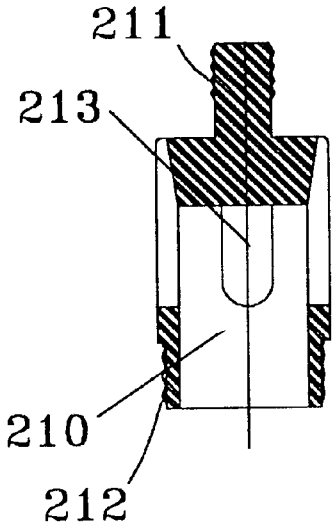
Figure 8A:
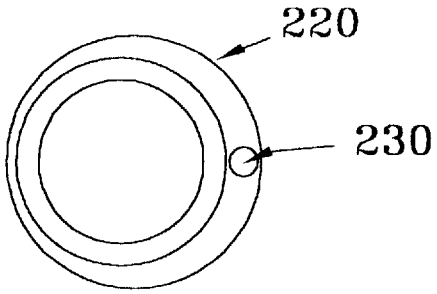
FIGS. 8A, 8B & 8C are end and two, exploded, cross-sectional views, respectively, of two similar but alternative, exemplary, optional diluent check valve system elements, having two alternative diluent injection points, the latter one of which is illustrated in FIG. 8D, described below.
Figure 8C:
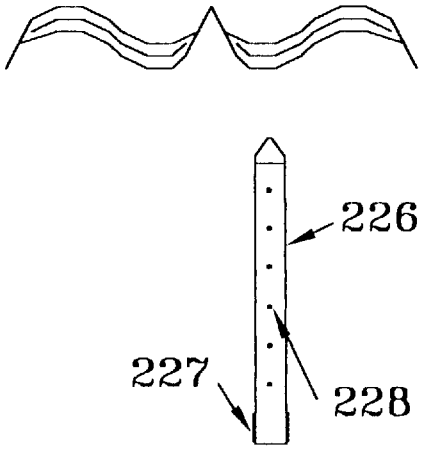
Figure 8C:
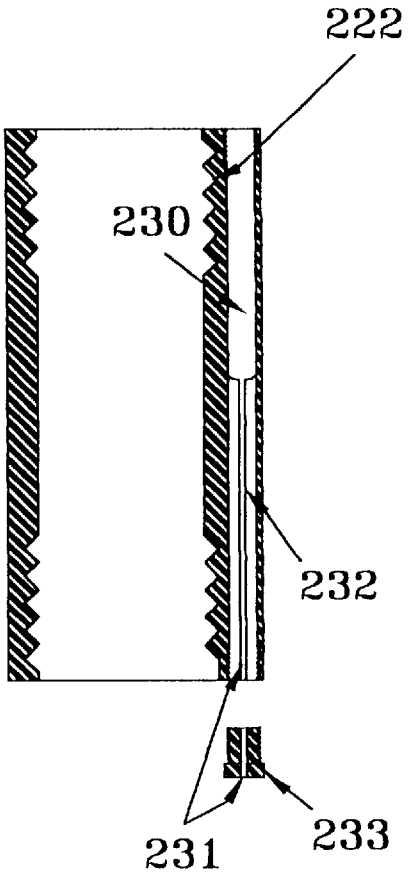
Figure 8B:
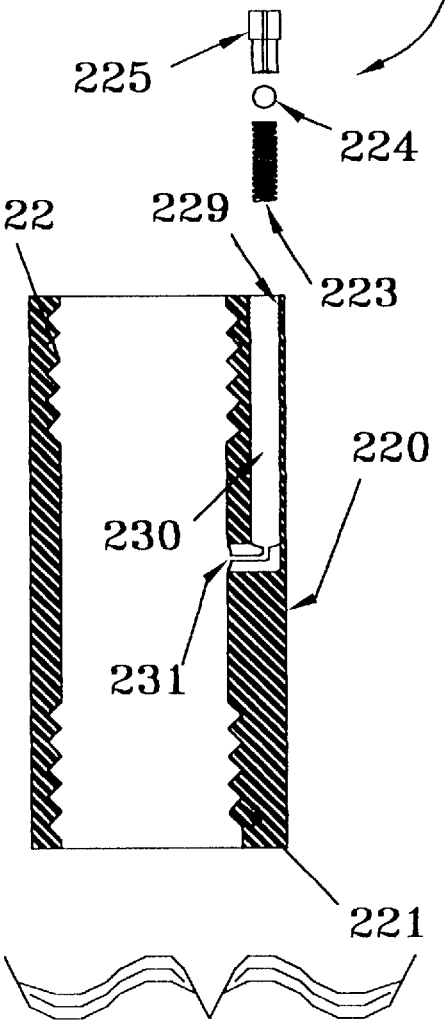
Figure 8D:
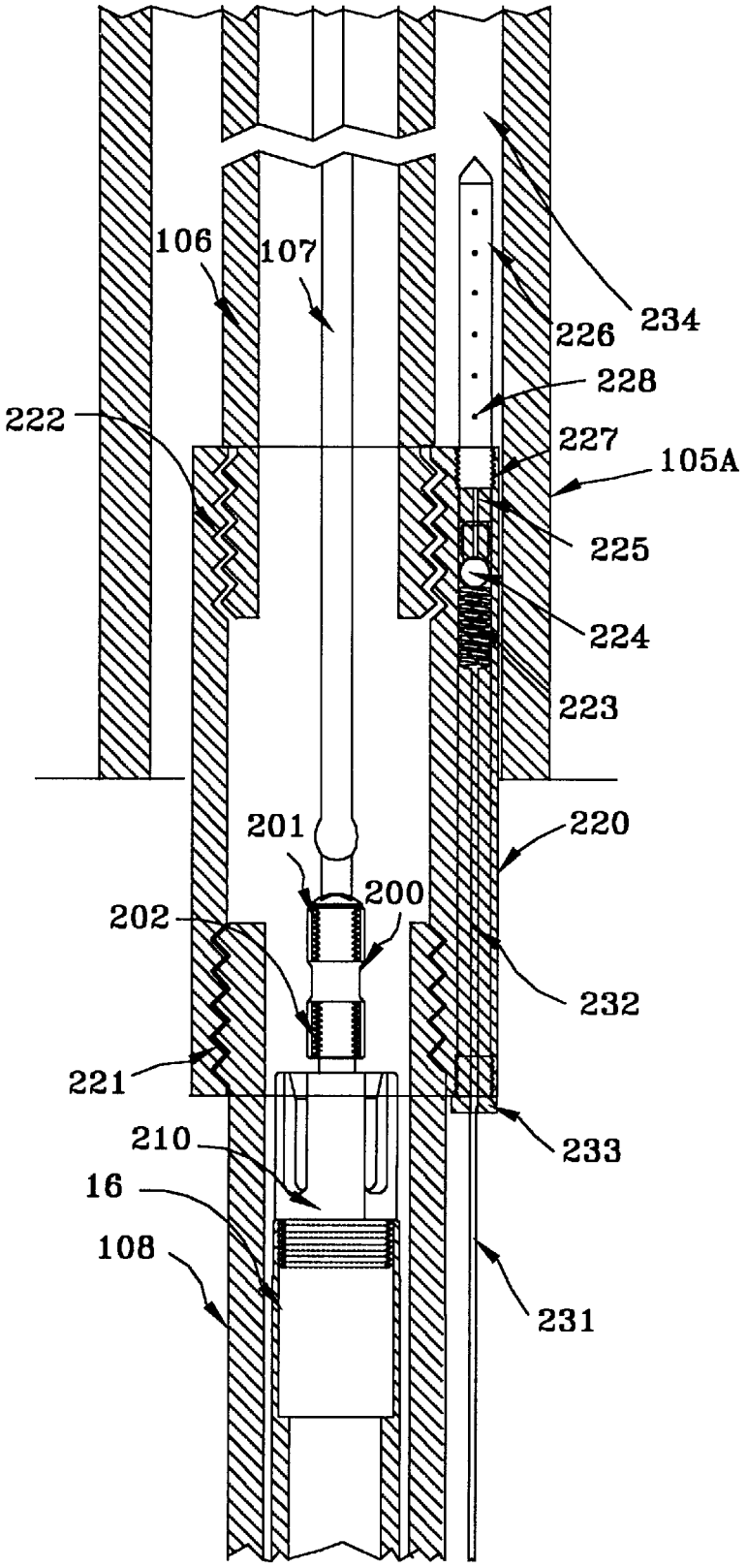
FIGS. 8D & 9A are cross-sectional views of two, alternative, optional, diluent injection system embodiments, namely, a diluent check valve system option (FIG. 8D) and a standing valve system option (FIG. 9A).
Figure 9A:
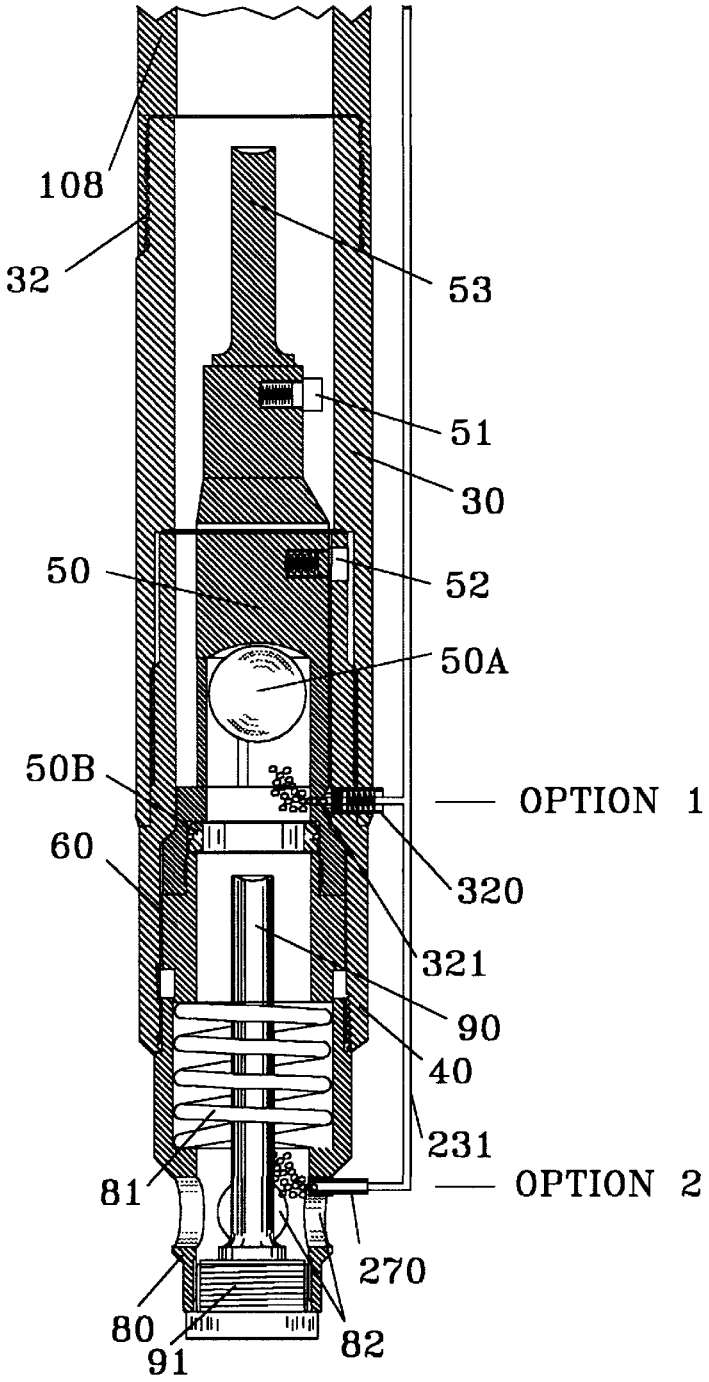
Figure 11:
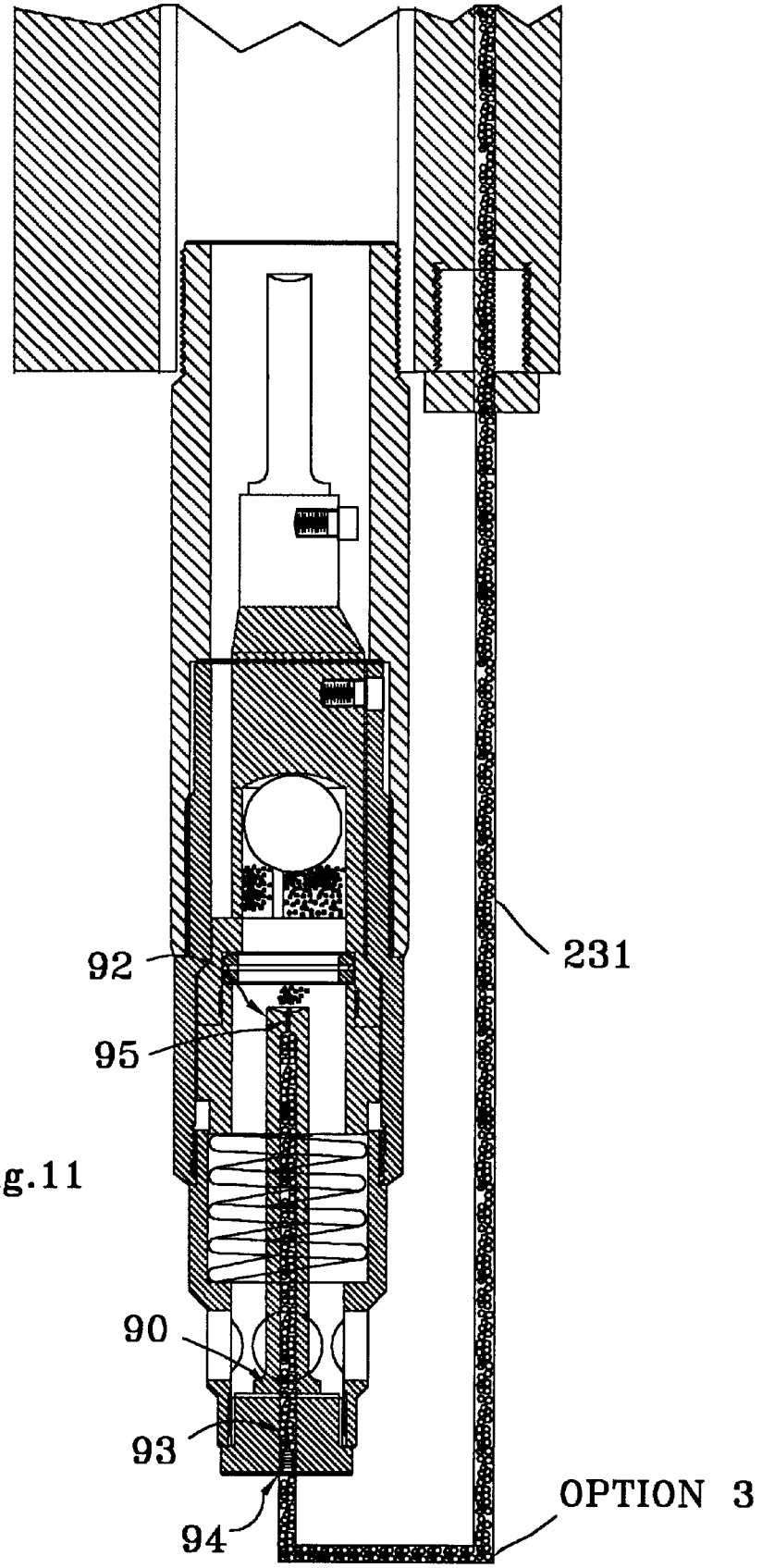
FIG. 11 is a cross-sectional view of a third embodiment using the diluent injection system option of the invention.

As can be seen in assembled combination in FIG. 9 and in detail in FIG. 8D, the exemplary embodiment of the fluid injection means for the down-hole, production pump and circulation system comprises the following basic parts:

- a sucker rod connector or union 200, (note FIG. 8D) which has threads 201 and 202, on both ends, where threads 201 connect to sucker rod 107 (note FIG. 8D), and thread 202 which connects to plunger connector 210 (note FIGS. 4A–4C) at threads 211;
- a plunger connector 210 (note FIGS. 4A–4C), which is attached to sucker rods 107 and traveling hollow plunger 16 with thread 212 connecting threads 16A (note FIGS. 7 & 8D), and having windows 213 which allows for fluid passage from the plunger 16 to the inner tubing 106;
- a hollow pump barrel 108 (note FIGS. 6A–6D) with a barrel channel 108B with a special inner liner 108G, and a special outer liner 108E which consist of "Xaloy"™ (X-800 alloy, tungsten carbide particles dispersed in a nickel alloy matrix or X-830), bimetallic, or ceramic barrel linings that withstand temperatures ranging up to 650° C. (1200° F.) or more. The walls of the barrel 108 are thick enough so that the diameter of the barrel will not reduce the velocity or pressure of the pumped fluid as it enters the barrel. This will prevent the barrel from breathing, inhibiting the efficiency of the pumping process. The barrel also has a barrel injection channel 108C which can hold tubing 231 (see FIGS. 8B & 8C). The barrel is constructed using two sections which are butt-welded together at 108A (note FIGS. 6A–6D);
- an inconel X-750 spring 81 (note FIG. 2);
- a barrel connector or union 220 (note FIGS. 8A–8C), with threads at both ends. Thread 222 connects to bottom section of tubing 106 and thread 221 connects to barrel 108 at 108A (note FIG. 6A) which has a longitudinal hole 230 in barrel connector 220, which allows for the placement of a spring 223 and a ball 224 and a hollow longitudinal seat pin 225, which comprises the components for a 50 psi check valve, and a nipple 226, which is threaded into the barrel connector 220 with threads 227 to threads 229 (note FIGS. 8B & 8D). Nipple includes six holes 228 which are peripherally spaced on the nipple (note FIGS. 8B & 8D). Note that FIG. 8C shows an optional embodiment for use with option 1, option 2 and option 3 as shown in FIGS. 9A & 11; and
- a standing valve injector 320 (note FIGS. 9B & 9C), which is comprised of a hollow sleeve 280, with external threads 281, a plunger/nozzle injector 290, which is inserted into 280 at 285, to rest injector flange 291 on shoulder 284, a spring 300, which is inserted into 280 resting in channel 283, a hollow second longitudinal seat pin 310 with external threads 311 on one end which are threaded into 280 at threads 282 to hold spring 300 and plunger/nozzle injector 290 in place;

A traveling valve cage 17 (note FIG. 5B) which is inserted into the bottom of plunger 16 at 16B. The valve cage has valve openings 17A, which are defined by the valve's radial members 17B. These allow for fluid flow through the valve. The traveling valve ball 11 (note for example FIG. 10B) is placed into the traveling valve cage 17 at 17C (note FIG. 5B). The traveling valve seat 12 is placed at the bottom of the traveling valve cage 17 at 17D (note FIG. 5B). All of these components are held in place by a fishing tool section 20 (note FIGS. 1 & 2) by threading threads 13 into threads 16B of plunger 16 (note FIG. 7).

The pump barrel 108 can be threaded using option 1 into tubing 106. Using option 2, the pump barrel 108 can be threaded at threads 221 into the pump barrel connector 220. In turn, threads 222 of the pump barrel connector 220 would be threaded into the bottom section of the tubing 106, as can be seen in assembled combination in detail FIG. 8D, which also demonstrates placement of the nipple 226, inside of annulus 234, and of the inner casing 105A.

By the use of packing at the lower extreme of the inner casing 105A, diluents/surfactants can be injected into the inner casing 105A, filling the inner casing annulus 234 between the tubing and casing wall 105, which allows for the nipple 226 of barrel connector 220 to be submerged in diluents/surfactants. This allows for diluents/surfactants to enter through the holes 228 of the nipple 226, through the check valve and tubing 231 down to either option 1 (see FIG. 9A) using the standing valve injector 320 (see FIGS. 9B & 9C), or option 2 (see FIG. 9A) using an atomizer/injector 270, or option 3 (see FIG. 11) using the lower, standing valve projector 90.

Exemplary Dimensions for the Tool 1

The biasing spring 81 can have, for example, an outer diameter of two and three-quarters (2.75") inches and an inner diameter of two (2") inches, with a natural, uncompressed length of three and a half (3.5") inches and a compressed length of one and seven-eights (1⅞") inches and five (5) total coils, producing six hundred and eighty-five (685 lbs./") pound per inch compression or pushing force.

The longitudinal length of the tool can be, for example, about five hundred and fifty-two and a half (552.5 mm) millimeters from the top of the sleeve 30 to the bottom of the projector 90, while the over-all diameter of the tool can be about, for example, one hundred and three (103 mm) millimeters (when measured, e.g. at the O.D. of the sleeve 30).

The tool 1 is symmetrical about the longitudinal, centerline axis 14, and all of the parts can be made of metal with the exception of the "O" rings 15 & 50C, which typically are made of "Viton" or the like.

Of course, the foregoing dimensions and specifics are subject to great variation.

Operation of Tool 1

Figures 3, 3A:
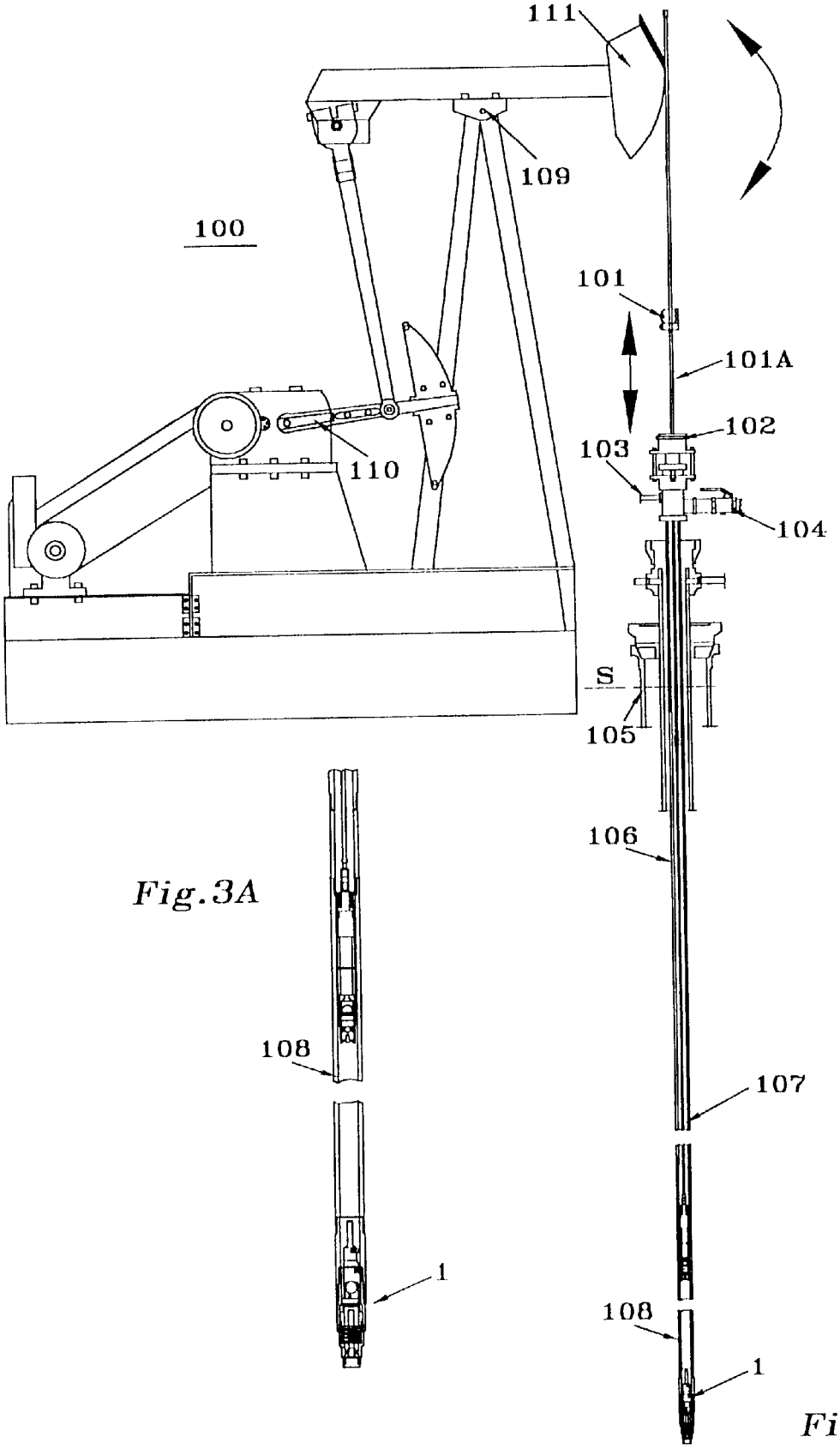
Figure 5A:
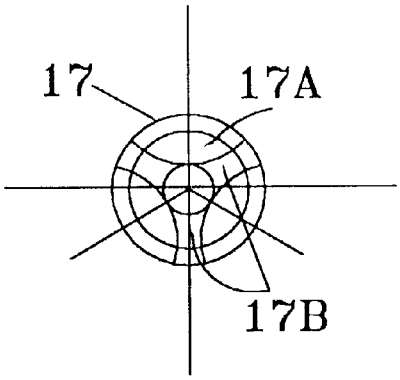
FIGS. 5A & 5B are end and side-cross-sectional views, respectively, of the traveling valve cage element (17) of FIGS. 10A–10D, described below.

As can be seen in FIG. 3, an exemplary production well includes a "horse head", reciprocating pump 100 located on the surface S with its ancillary equipment, including typically a polished rod clamp 101 located above a stuffing box 102, a bleeder 103 and a flow line 104. The production well further typically includes an outer casing 105 enclosing inner, tubing 106, with a series of sucker rods 107 attached together with a barrel 108 at their down-hole end.

A typical production well might go down, for example, about four thousand (4,000') feet from the surface "S". The reciprocating horse head pump 100 is pivotally driven about a horizontal pivot axis 109 by the drive unit 110, causing the horse head 111 to reciprocate back and forth (note curved direction arrow), cyclically pulling up the sucker rod string 107 and its attachments in an "up" stroke and driving them back down in a "down" stroke (note vertical directional arrow) to pump up the production fluid in a cyclical "sucking" operation, well known to those of ordinary skill in this art.

Such a production fluid pumping system typically further included a traveling plunger carrying a traveling ball valve in a cage working and moving up-and-down within the down-hole barrel, which at its end carried a standing ball valve, both having valve seats below them. The upper traveling ball valve and the lower, standing ball valve cyclically opened and closed under the reciprocating suction, up-stoke action and re-setting, down-stroke action of the various mechanical force, pressure and fluid flow parameters caused by the movement of the horse head 111.

However, instead of using the standard, standing valve structure of the prior art, in the invention the tool 1 of FIGS. 1+ is located during use down at the bottom of the hole attached by a screw threaded engagement (using top end threads 32) to the distal end of the well production barrel 108. [It is noted that part of the sucker rod string 107 is cut away for convenience in illustrating the over-all system on a single page of drawings, and in fact the bottom part (including the tool 1) of FIG. 3 typically would be thousands of feet down in the ground.]

When the tool 1 is shipped to a job site or a pre-use test facility, it typically will be in the disposition shown in FIG. 10A, in which shipping disposition the radially directed pins 52 will hold the tool 1 with the standing valve ball 50A in its "locked open" position. As can be seen in the figure, each pin 52 will then be locked into the upper portion of the lower foot of the "J" hook shape under the compressed, upwardly directed force of the spring 81, and in such a disposition the upper end 92 of the projector 90 pushes and holds the standing valve ball 50A off of its seat SOB. This position is considered to be in the "zero (0°) degree" position for relative reference purposes.

Although not illustrated, during shipment appropriate protective caps and packing will be included on and within the tool 1 to protect its parts during shipment.

As can be seen in FIG. 10B, the tool's pumping disposition is achieved by lowering the plunger 16 and traveling cage with the traveling assembly 10 and fishing tool section 20 attached at its bottom down until the grasping, radially directed pins 51 enter into the entries 21 and travel up into the pin holding channels 22 of the fishing tool section, and the sucker rod string 107 is then pushed down using the weight of the string and any other needed supplemental force against the force of the spring 81, causing the guide pins 52 to then travel down to the bottom of the foot 45 of the "J" shape. The upper, inner portion 50 (along with bushing 60) of the tool 1 is then twisted clock-wise about thirty-two (32°) degrees about the axis 14 with respect to the main body (30, 40 & 80) of the tool bringing the guide pins 52 into the shanks or vertical lengths 44 of the slots 43.

The guide pins 52 are then allowed to move up the shank of the "J" slots by reducing the weight and downward force, allowing the pushing force of the high strength spring 81 to move it up until the pins 52 reach the top of the shank of the slot 43, until a further, final twist of the sucker rods and hence the traveling assembly 50 to about the sixty-two (62°) degree position causes the pins 52 to enter the tails 46 of the slots, where they become locked into the tails. This pin position provides a "valve locked closed" disposition.

Figure 10C:
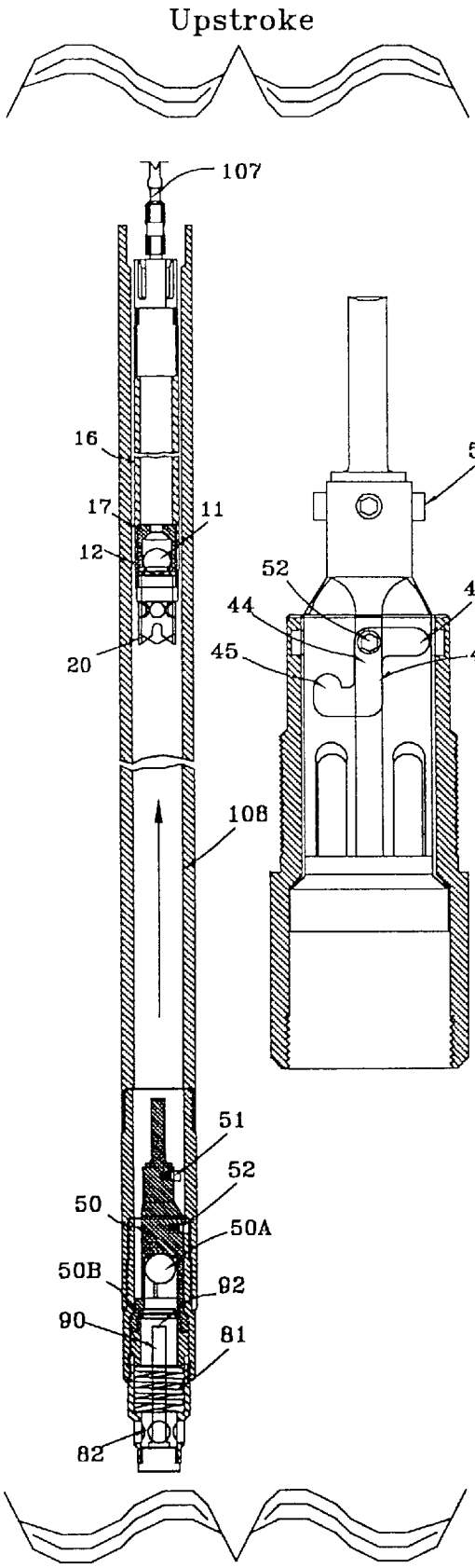
Figure 10D:
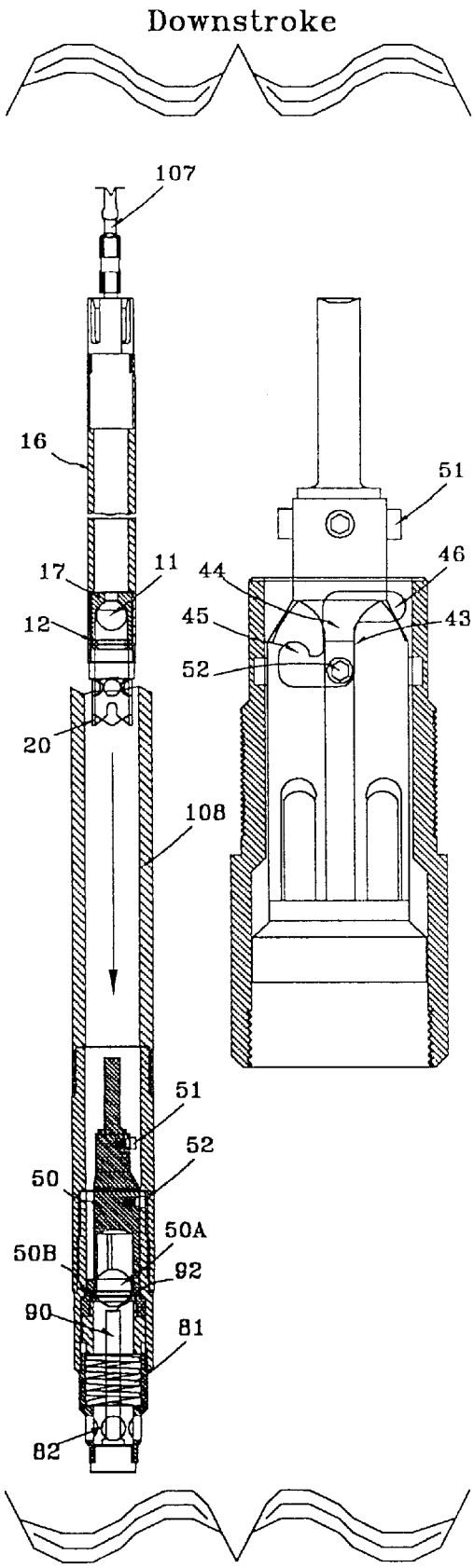

This "valve locked closed" disposition is typically maintained throughout the use of the tool 1 during the reciprocating, cyclical pumping operation, with the "up" stroke being shown in FIG. 10C and the "down" stroke shown in FIG. 10D. In the "up" or sucking stroke the lower, standing valve ball 50A is pulled up off of its seat 50B by the upward flow of the production fluid, while the upper, traveling ball remains on its seat 12, while in the "down" or return stroke the lower, standing valve ball 50A is pushed down onto its seat 50B by the downward pressure caused by the downward movement of the plunger 16, while the upper, traveling ball becomes unseated, allowing any production fluid remaining between it and the lower valve to rise above it.

The foregoing "up" and "down" stroke actions are cyclically repeated under the reciprocating action of the pump 100 on the surface "S". In such actions the plunger 16 and the bottom connector 10 & fishing tool section 20 never come into contact with the rest of the tool 1, a set amount of "spacing" being set in the system by the placement of the polished rod clamp 101 on the polished rod 101A.

A total of two roughnecks or roustabouts can change the tool 1 to its activated disposition (FIG. 10E), allowing treatment fluid to be pumped down into the hole from the surface "S", when it is desired. The roughnecks or roustabouts brake the pump 100 and loosen the rod clamp 101 and readjust its position on the polished rod 101A, moving it up, for example, eighteen inches (or a few inches more than whatever preset, spacing distance had been set up for the pumping action). This adjustment allows the fishing tool section 20 to engage and grip the gripping pins 51 (as illustrated) on the down stroke.

With the braking to the pump 100 re-applied, the polished rod 101A above the stuffing box 102 is turned or twisted with, for example, a wrench in a clockwise direction until a "stop" (caused by the pin 52 hitting the top end of the slot shank 44) is reached. The weight of the sucker rods 107 and the hydrostatic load then activates the tool 1 by pushing the pin 52 (and hence the assembly 50) down until the pin reaches the bottom of the slot shank 44 (as shown in the supplemental slot diagram of FIG. 10D), compressing the spring 81.

This allows the standing valve assembly 50 (with the seat 50B) and bushing 60 to lower, resulting in the projector section 92 projecting through the open center of the seat, unseating the lower, standing valve ball 50A and lifting it up off the seat. Additionally, with the traveling ball assembly lowered unto the tool 1, the upper projector 53 projects up through the open center of the seat 12, unseating the traveling valve ball 11 from its seat.

Thus, both the upper and lower ball valves are open, allowing any pressurized or pumped fluid, such as, for example, treatment chemicals, steam, etc., from the surface "S" to be injected down into the well and the surrounding formation, all without the removal of the tubing or sucker rod strings. Circulation can now begin. If it is desired to lock the tool 1 in this activation disposition, the sucker rods 107 via the polished rod 101A is then further twisted, until the pin 52 enters back into the slot foot 45 (note lined pin position 52 in FIG. 10E) and is locked thereby by the force of the compress spring 81.

On the upstroke of the horse head of the pumping jack, the plunger 16, which is spaced approximately 18 inches above tool 1, as seen in FIG. 3, travels in an upwardly motion through the inner most part of the barrel 108, with the tolerance between the said parts being, for example, 0.0002 to 0.0005, causing suction, which lifts the standing valve ball 50B off the standing valve seat 50A by the production fluids entering the openings 82, as seen in FIG. 1 and FIG. 10C. Diluents/surfactants may be blended or mixed with the production fluids in a variety of ways. Several options are outlined below.

Figure 12:
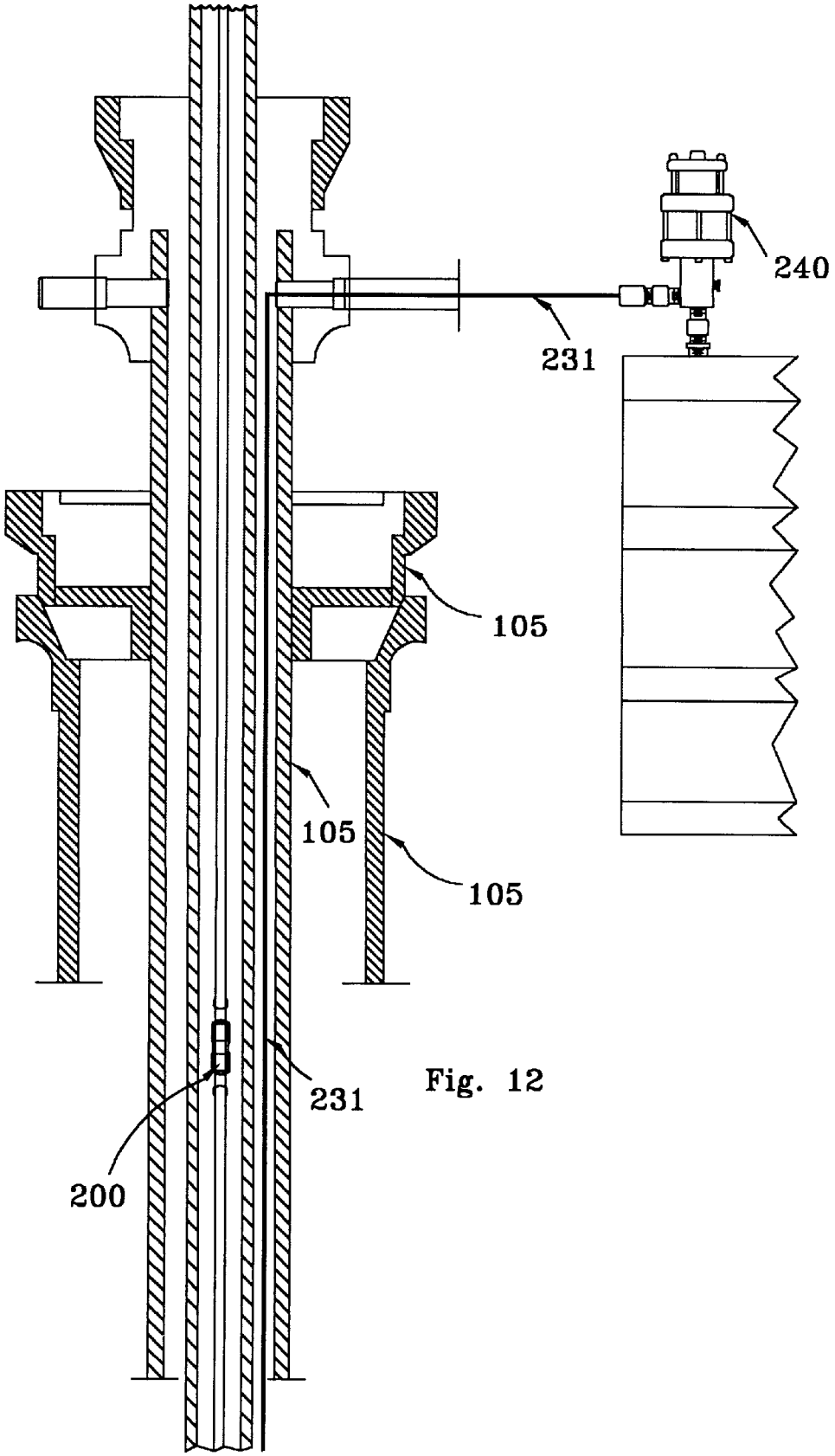
FIG. 12 is a simplified, side, detailed view of the overall elements of the system at or near ground level, showing the above-ground, injection pump supply of the injection fluid for the down-hole tool of the invention.
Figure 13A:
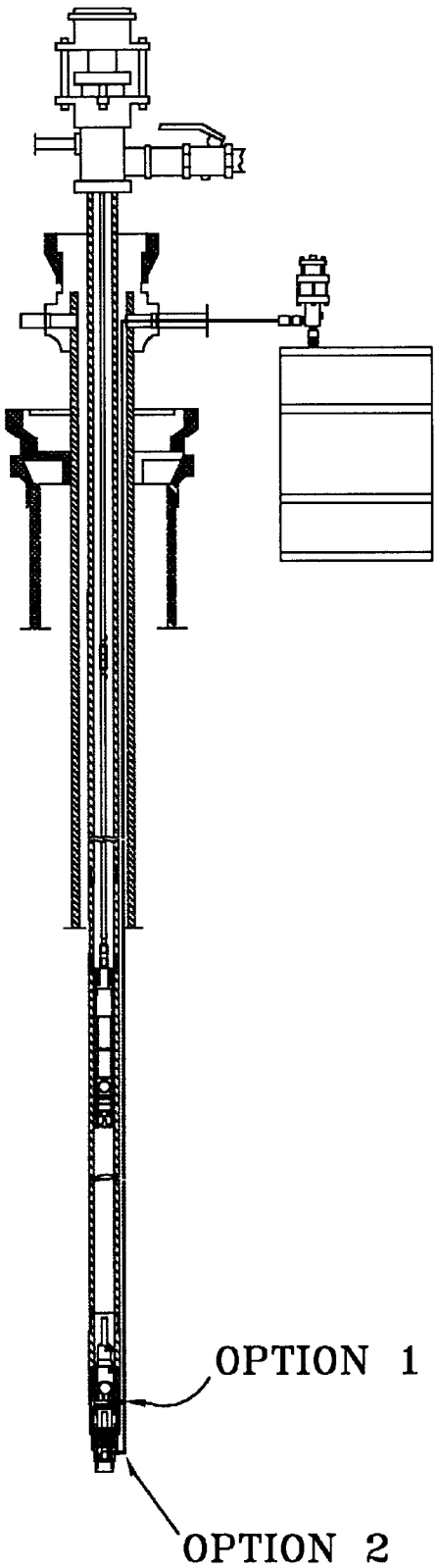
FIGS. 13A & 13B are side, simplified views of the overall system, showing both the at or near ground level components, as well as the down-hole, tool components, of the exemplary system of the present invention, with FIG. 13A illustrating the relative injection points for two injection options (options 1 & 2), and with FIG. 13B showing the relative location of a fourth option.
Figure 13B:
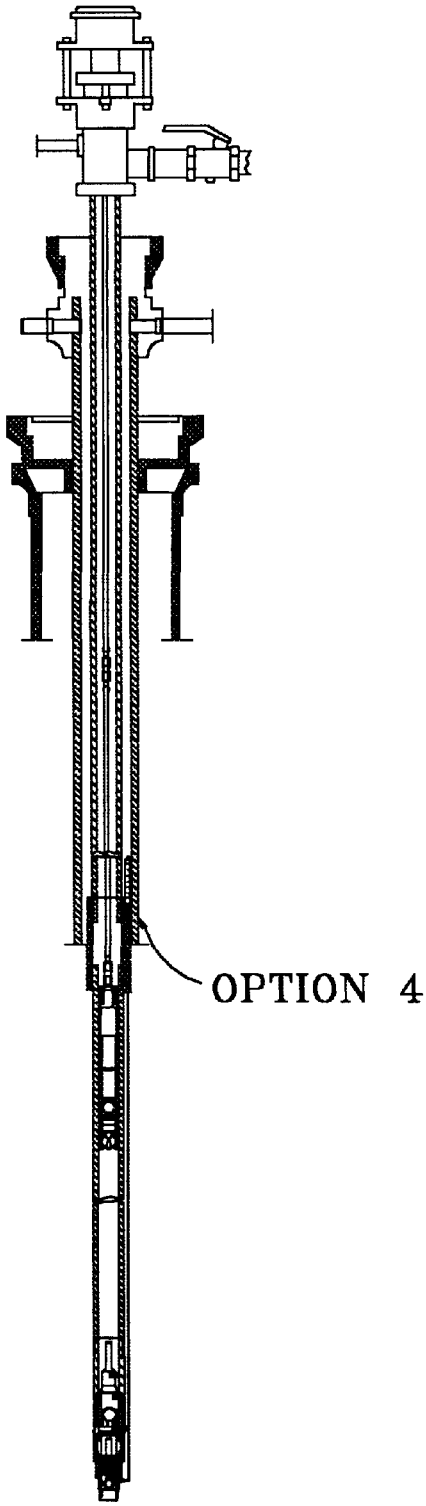

Using option 2 as seen in FIG. 9A, diluents/surfactants are introduced through an atomizer/injector 270, at the base of the lower valve projector 90, as seen in FIG. 9A, and blended or mixed with the production fluids. Option 2 can be fed by the use of an injector pump 240, as seen in FIG. 12, at the surface, which injects the diluents/surfactants through the tubing 231 into the inner casing 105A and passes through the annulus 234 down to the atomizer/injector 270 (see FIG. 9A). Option 2 can also get its feed from a nipple 226, placed in the annulus 234 which is filled with diluents/surfactants. Diluents/surfactants are drawn through the holes 228 of the nipple 226, through the check valve, tubing 231 and into the atomizer/injector 270.

Figure 9B:
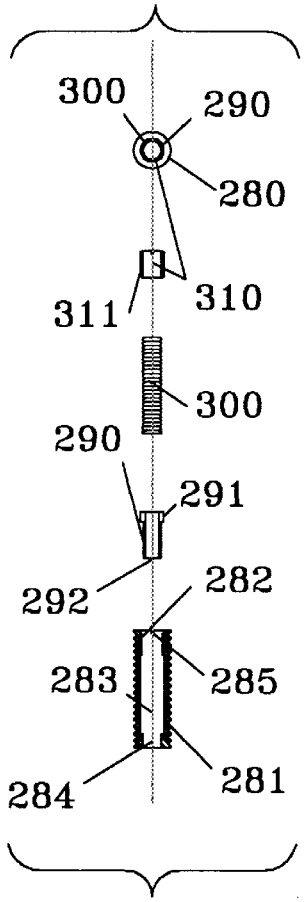
FIG. 9B includes end-assembled and side-by-side, cross-sectional views of the four components for the exemplary standing valve injector (320) of FIG. 9C of the embodiment of FIG. 9A.
Figure 9C:
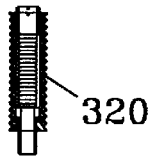

Option 1, as shown in FIG. 9A, can also get its feed from either of the above mentioned sources, through the nipple and check valve, or through the annulus. In using option 1, this standing valve injector 320, as seen in FIGS. 9B & 9C, is threaded through the sleeve 30 of FIG. 9A into the "J" slot member 40 of FIGS. 1, 2 & 9A, with only the nozzle 290 protruding through and resting against the standing valve at the standing valve inlet 321, when the system is in the pumping position. On each upstroke, diluents/surfactants are introduced through the standing valve injector inlet eight to ten (8–10 mm) millimeters above the standing valve seat 50B. At the same time the production fluids are passing through the opening of the standing valve seat 50B and are blended or mixed by the turbulence of the production fluids, which reduce the viscosity and allow the fluid to pass through the windows 213 upward over the diffusers, which results in a homogenous distribution of the production fluids and diluents/surfactants. Both options allow for a reduction in viscosity and easier passage of the production fluids through the pumping device.

An option 3 includes a lower projector channel 93 (see FIG. 11), which extends longitudinally through the lower, standing valve projector 90. Again, the feed may come from either the nipple and check valve or the annulus. It is preferred with this option that the lower projector channel narrow towards its upper end 92 to act as a nozzle 95 for injecting the fluid. Also threads 94 are provided for attaching the tubing 231. Again, this allows for a reduction in viscosity and easier passage of the production fluids through the pumping device.

While the present invention has been shown and described in what is at this time currently believed to be most the practical and preferred embodiment, it is recognized that departures may be made therefrom within the scope of the invention, which therefore is not to be limited to the details disclosed herein, but it is to be accorded the full scope of the claims as to embrace any and all equivalent devices and approaches.

It is noted that the embodiment described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A down-hole circulation tool for use down-hole in a production well having a production tubing string and an inner plunger carried by a sucker rod string in association with a reciprocating pumping system on the surface, comprising:

a basic body attachable to the bottom of the tubing string which remains substantially stationary in use;

two ball valves in line, one above the other, associated with said basic body, each having a ball and a valve seat;

a lower projector located at the bottom area of the tool which is projectable through said valve seat of said lower valve, unseating its ball; and an inner body which is rotatable about a longitudinally axis and longitudinally moveable with respect to said basic body and is temporarily attachable to the bottom of the plunger through a tool section;

the relative longitudinal positioning of said inner body with respect to said basic body defining two, distinctively different dispositions for the tool, a usual, closed, production disposition in which production flow pumping takes place using the reciprocating pump, and an injection, open disposition in which fluids from the surface are injected down the production tubing through the down-hole tool on an intermittent basis.

2. The down-hole circulation tool of claim 1, wherein there is further included an injection system fed with fluid by an injector pump located on the surface and comprising an injection fluid tube leading from the injector pump, into a longitudinal hole within a barrel connector, said barrel connector connecting the tool to a barrel and the production tubing string, said longitudinal hole aligning with a barrel channel through the barrel, and the injection fluid entering the down-hole tool through entry means.

3. The down-hole circulation tool of claim 2 wherein the barrel connector further comprises:

a check valve with a spring inserted at the bottom of the longitudinal hole;

a ball positioned on top of the spring in the longitudinal hole; and a hollow longitudinal seat pin positioned on top of the spring.

4. The down-hole circulation tool of claim 2, wherein the entry means further comprise a channel into the center of the barrel connector from the bottom of the longitudinal hole.

5. The down-hole circulation tool of claim 2, wherein the entry means further comprise a second inner tube leading from the base of the longitudinal hole to a first injection means, or a second injection means, or a third injection means.

6. The down-hole circulation tool of claim 5, wherein the first injection means further comprise a standing valve injector positioned so as to receive the fluid from the injection fluid tube and inject it into the down-hole circulation tool adjacent the second ball valve.

7. The down-hole circulation tool of claim 6, wherein the standing valve injector further comprises;

a hollow sleeve with external threads for connection into the down-hole circulation tool adjacent the second ball valve and internal threads at its entry;

a nozzle injector insertable into the hollow sleeve;

a spring insertable behind the nozzle injector into the hollow sleeve; and a threaded seat pin for securing the spring and nozzle injector in the hollow sleeve at the internal threads.

8. The down-hole circulation tool of claim 5, wherein the second injector means comprise an atomizer injector positioned adjacent the base of the lower projector located at the bottom area of the tool and connected to the injection fluid tube.

9. The down-hole circulation tool of claim 5, wherein the third injector means comprise a projector channel formed inside the lower projector and connected to the injection fluid tube; said projector channel having a diameter that is reduced at the upper end of the lower projector.

10. A method of down-hole circulation in a production well including a production tubing string using a reciprocating pumping system on the surface to pump the production fluid from down in the well using a plunger, comprising the following steps:

a) providing a tool down-hole at the bottom of the production string, having a basic body attachable to the bottom of the tubing string which remains substantially stationary in use;

two ball valves in line, one above the other, associated with said basic body; and an inner body which is rotatable about a longitudinally axis and longitudinally moveable with respect to said basic body;

b) changing the relative longitudinal positioning of said inner body with respect to said basic body to change the tool between two, distinctively different dispositions, namely, a usual, closed, production disposition in which production flow pumping takes place using the reciprocating pumping system, and an activation, open disposition in which fluids from the surface are injected down the production tubing string through the down-hole tool on an intermittent basis; and c) using a tool attached to the bottom of the plunger to temporarily engage the top of said inner body and rotating the engaged top of said inner body with respect to a longitudinal axis with respect to said basic body, changing the tool's disposition.

11. The method of claim 10 wherein there is further provided the step of:

injecting fluids from the surface from an injection system fed with fluid by an injector pump located on the surface and comprising an injection fluid tube leading from the injector pump, into a longitudinal hole within a barrel connector and entering the down-hole tool through entry means.

12. The method of claim 11 wherein the injecting step is further comprised of the additional step of:

injecting fluid through entry means comprising a standing valve injector positioned so as to receive the fluid from the injection fluid tube and inject it into the down-hole circulation tool adjacent the lower ball valve.

13. The method of claim 11 wherein the injecting step is further comprised of the additional step of:

injecting fluid through entry means comprising an atomizer injector positioned adjacent the bottom area of the tool and connected to the injection tube.

14. The method of claim 11 wherein the down-hole tool further has a lower projector, and wherein the injecting step is further comprised of the additional step of:

injecting fluid through entry means comprising a projector channel formed inside the lower projector and connected to the injection tube.

* * * * *